US006749097B1

(12) United States Patent
McElhinny

(10) Patent No.: US 6,749,097 B1
(45) Date of Patent: Jun. 15, 2004

(54) PLASTIC FILM WRAP APPLICATION PROCESS DISPENSER

(76) Inventor: John Albert McElhinny, R.D. 8 Box 8, Brookville, PA (US) 15825

( * ) Notice: Subject to any disclaimer, the term of this patent is extended or adjusted under 35 U.S.C. 154(b) by 504 days.

(21) Appl. No.: 09/803,542

(22) Filed: Mar. 9, 2001

(51) Int. Cl.[7] ..... B26F 3/02

(52) U.S. Cl. ..... 225/20; 225/25; 225/43; 225/51

(58) Field of Search ..... 225/43.51, 39, 225/19, 20, 25, 52, 54; 83/649

(56) References Cited

U.S. PATENT DOCUMENTS

| | | | | | |
|---|---|---|---|---|---|
| 2,670,041 | A | * | 2/1954 | Krueger | 225/20 |
| 2,969,169 | A | * | 1/1961 | Botnick | 225/43 |
| 3,240,093 | A | * | 3/1966 | Bell, Jr. et al. | 83/649 X |
| 3,384,280 | A | * | 5/1968 | Summersby | 225/43 X |
| 3,419,201 | A | * | 12/1968 | Brandon | 83/649 X |
| 3,517,870 | A | * | 6/1970 | Voytko | 225/52 X |
| 3,748,939 | A | * | 7/1973 | Feinstein et al. | 83/370 |
| 3,843,034 | A | * | 10/1974 | Lewandowsky | 225/43 |
| 3,991,923 | A | * | 11/1976 | Nishikawa | 225/20 |
| 4,417,495 | A | * | 11/1983 | Gordon et al. | 225/43 X |
| 4,586,639 | A | * | 5/1986 | Ruff et al. | 225/20 X |
| 4,666,072 | A | * | 5/1987 | McCarter | 225/25 |
| 4,844,310 | A | | 7/1989 | Geleziunas | 225/43 |
| 4,951,858 | A | | 8/1990 | Krall | 225/19 |
| 5,107,732 | A | * | 4/1992 | Hanmer | 83/649 X |
| 5,146,828 | A | * | 9/1992 | Huang et al. | 225/43 X |
| 5,193,726 | A | * | 3/1993 | Humphrey | 225/39 X |
| 5,292,046 | A | * | 3/1994 | Kaiser et al. | 225/19 |
| 5,383,590 | A | * | 1/1995 | Ho | 225/43 |
| 5,630,563 | A | * | 5/1997 | Meisner et al. | 225/43 X |
| 5,680,978 | A | * | 10/1997 | Pinion | 225/39 X |
| 5,768,968 | A | | 6/1998 | Park et al. | 83/614 |
| 5,928,466 | A | * | 7/1999 | Yu Chen | 225/20 X |
| 5,954,987 | A | * | 9/1999 | Han | 225/43 X |
| 6,039,102 | A | * | 3/2000 | Sadrakula et al. | 225/20 X |
| 2002/0079344 | A1 | * | 6/2002 | Pitzen et al. | 225/20 |

* cited by examiner

*Primary Examiner*—Charles Goodman

(57) ABSTRACT

A dispenser for a roll of plastic film wrap material, comprising a grooved base (22) defining an elongated trough and having a partial cylinder shaped roll top cover (52), said roll top cover being augmented by a saw tooth cutter (62) and a cutter safety guard (66). The roll top cover (52) is pivotably positioned between parallel end walls, which are constructed of furniture like material and support a space saver shelf (30). An inclined plane (40) stabilizes the roll of plastic wrap, and a static bar (36) holds the loose end of said plastic wrap.

8 Claims, 6 Drawing Sheets

PLASTIC FILM WRAP APPLICATION PROCESS DISPENSER

BACKGROUND FIELD OF INVENTION

This invention relates to a dispenser, and more particularly relates to a space saver plastic film wrap dispenser.

BACKGROUND DESCRIPTION OF PRIOR ART

Plastic wrap, wax paper, aluminum foil and related packaging and sealing material is manufactured in an elongated sheet, then wrapped on a roll. Such wrap material is usually dispensed from a cardboard box-like container having an exposed cutter along one side. Pulling a desired amount of material out of the container and by pressing said material against the cutter, separates the film from the dispenser.

Some manufacturers of plastic film wrap have down graded the clinging effect of their plastic wrap, just so said wrap can be dispensed and applied by consumers, thus defeating one of the major benefits of plastic film wrap.

Proposals have been made for dispensers to use plastic wrap with clinging properties, however prior dispensers suffer from a variety of disadvantages.

U.S. Pat. No. 4,844,310 Rimas J. Gelziunas 1989 tried to solve the clinging problems associated with plastic wrap dispensers by means of frosted surfaces. Coarse surfaces are prone to contamination. Assuming the dispenser worked as claimed, the plastic film wrap will still cling to the hands of a person using said dispenser during high static conditions.

U.S. Pat. No. 4,951,858 Kroll; Kenneth 1990, tries to solve the problem of dispensing plastic film wrap by using two hands, assuming there is no static condition present, one could awkwardly grasp and drag the wrap across the under side of the dispenser lid, possibly contaminating the film wrap or creating static. Cutting the film with a downward motion when the dispenser is sitting on a counter must be a problem.

U.S. Pat. No. 5,768,968 to Park; Houngho 1998, a dispenser having an electric motor, gears, belt and parts that become detached from the embodiment each time the dispenser is used.

SUMMARY

In accordance with the present invention there is provided a dispenser for a roll of plastic film wrap sheet material having sanitary application functions and a practical space saver shelf.

In brief a dispenser that is an integral part of the application process of plastic film wrap, and having practical utility when not dispensing material.

OBJECTS AND ADVANTAGES

Given today's life style, along with the aging baby boomer generation, plastic film wrap is used almost daily, with this thought in mind, the present invention is intended to stay on the kitchen counter.

A roll top cover permits easy access to the plastic film wrap, even for people with most disabilities. Simply open the roll top cover, pull enough plastic film wrap out to cover an object placed in front of the dispenser. Wrap the loose ends of plastic wrap around the object. Close the roll top cover, lift and pull the wrapped object away with a rotating motion, this will cut the plastic film wrap.

Being constructed mainly of furniture like material, the quality and stability of the dispenser blends well with the application process of plastic wrap and said dispensers' dormant utility. The space saver shelf provides extra space for commonly used kitchen items. The side walls that support the shelf can hold all sorts of kitchen utensils. The roll top cover is a partial cylinder shape, augmented with a saw tooth cutter that is shielded by a safety guard. When the plastic wrap is cut the loose end of the roll of wrap stay on a device in the dispenser called a static bar. The static bar effectively controls the problems associated with a high static cling condition common to plastic wrap. An inclined plane stabilizes the roll of plastic wrap within the dispenser and creates resistance along the bottom of said roll, permitting the use of a low profile roll retainer, with this configuration the surface of the plastic film wrap only touches the object being wrapped, thus providing a sanitary dispenser. Still further objects and advantages will become apparent from a consideration of the ensuring descriptions and drawings.

REFERENCE NUMBERS IN DRAWINGS

| | |
|---|---|
| 20 non-skid pad | 22 grooved base |
| 24 front groove | 26 back groove |
| 28 dispenser vertical end | 29 rabbet |
| 30 shelf | 32 vertical back |
| 34 front enclosure | 36 static bar |
| 38 roll retainer | 40 inclined plane stabilizer |
| 42 slot | 44 curved back enclosure |
| 46 back enclosure lug | 47 tenon |
| 48 ramp | 49 lug receiver |
| 50 loading guide | 52 roll top cover |
| 53 loading guide bevel | 54 roll top cover end |
| 55 guide support pin | 56 swivel pin |
| 58 pivot socket | 60 handle |
| 61 cutter attach slot | 62 saw tooth cutter |
| 63 lift tab | 64 push tab |
| 65 cutter guard slide | 66 cutter safety guard |
| 67 nub | 68 safety guard retainer |
| 69 safety guard retainer mount | 70 handle & retainer screw |
| 72 safety guard activator | 74 phantom hands & plate graphics |
| 75 back groove lock assembly | 76 phantom roll of plastic wrap |
| 78 phantom loose end of plastic wrap | 95 cutter housing |
| 85 front assembly | |

DETAILED DESCRIPTION OF A PREFERRED EMBODIMENT

Figure 1:
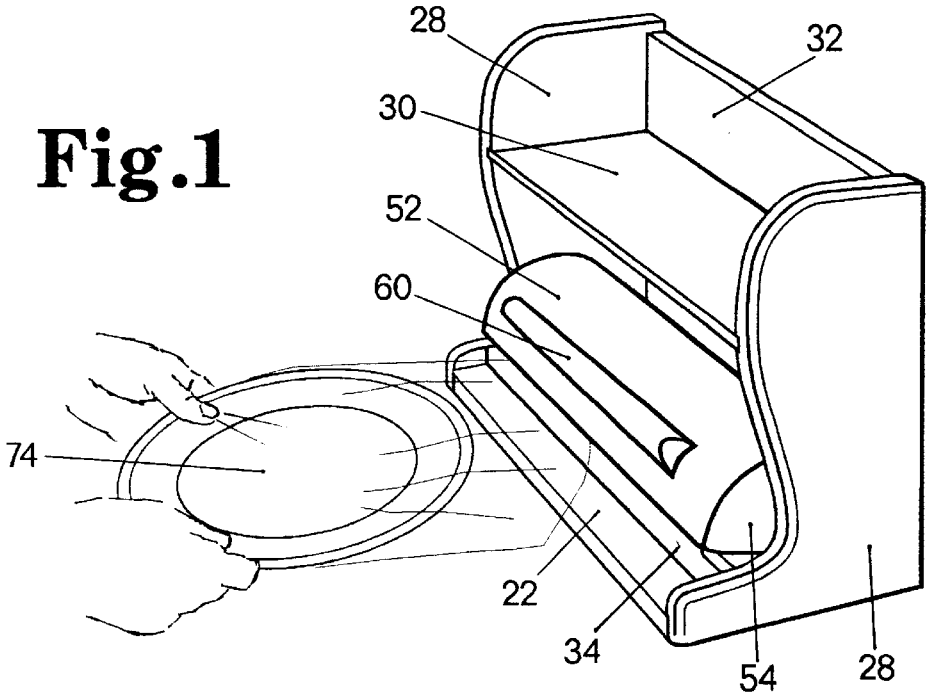
FIG. 1 is a perspective view illustrating the outward appearance of a plastic film wrap application process dispenser in accordance with the present invention.

FIG. 1 is a perspective front view illustrating the outward appearance of a plastic film wrap application process dispenser, in accordance with the present invention. The visible parts of the embodiment are a grooved base 22, front enclosure 34, dispenser vertical ends 28, shelf 30, vertical back 32, handle 60, roll top cover 52, and roll top cover end 54. The phantom hands and plate graphic 74, is just to show dispenser function.

Figure 2:
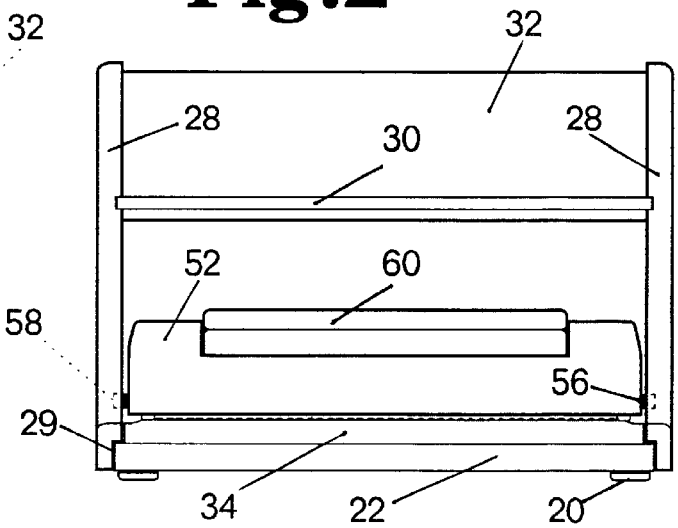
FIG. 2 is a front view of the plastic film wrap application process dispenser of the present invention.

FIG. 2 is a front view of the plastic film wrap application process dispenser in accordance with the present invention. Non-skid pads 20 are attached to the underside of the grooved base 22, at all four corners. The dispenser vertical ends 28 are rabbeted 29 along the bottom inward facing surface and attached to the grooved base 22 at right angles to said base. Roll top cover pivot sockets 58 are located and drilled into the dispenser vertical ends 28. Horizontal grooves are cut into the dispenser vertical ends 28, to receive a shelf 30. There is a groove cut near the bottom of the vertical back 32, to receive the back side of the shelf 30, when the vertical back 32 is fastened between the dispenser vertical ends 28. A roll top cover 52 has swivel pins 56 that rotate in the pivot sockets 58, that are drilled into the dispenser vertical ends 28. The front enclosure 34 is part of a front stop assembly 85. See FIG. 5.

Figure 3:
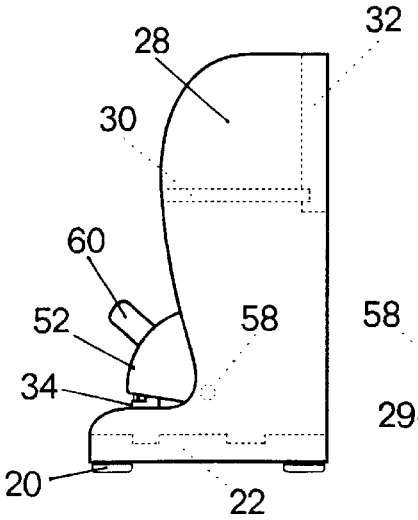
FIG. 3 is a side view of FIG. 2.

FIG. 3 is a side view of FIG. 2 in accordance with the present invention. The dispenser vertical end 28, has a horizontal bottom with a straight back perpendicular of said bottom. The top of said end starts out parallel to the bottom, then gradually curves downward into a concaved front opening, then curves outward to horizontal, then with a subtle curve returns to the horizontal bottom. The dotted lines show the grooved base 22, pivot socket 58, shelf 30 and vertical back 32, in relation to the dispenser vertical end 28. The roll top cover 52 partially extends out from the dispenser vertical end concaved front opening.

Figure 4B:
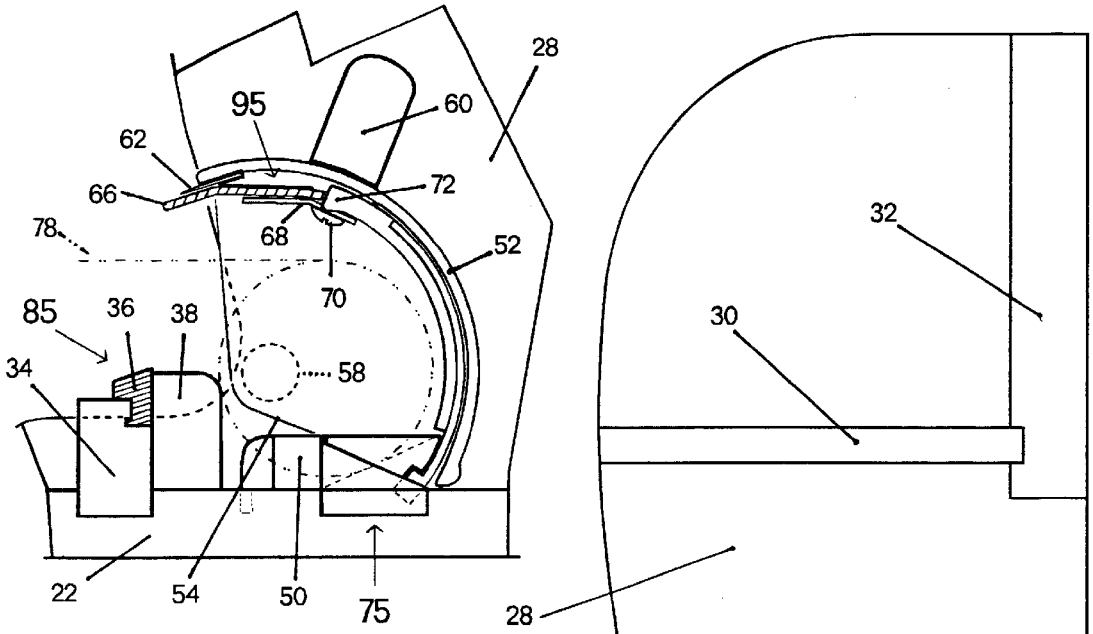
FIG. 4B is a cutaway side view of FIG. 4A when the roll top cover is in the open position.
Figure 4A:
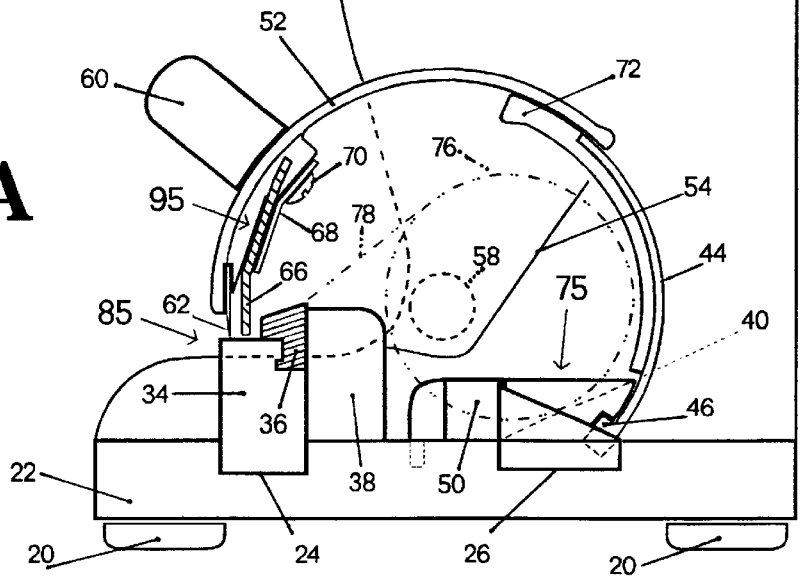
FIG. 4A is a cutaway side view illustrating the orientation of the present invention when the roll top cover is in the closed position.

FIG. 4A is a side view illustrating the orientation of the plastic film wrap application process dispensers' parts when the roll top cover 52 is in the closed position. The front assembly 85, which lifts out of the dispenser when loading, consists of a front enclosure 34, static bar 36 and a roll retainer 38. The roll top cover 52 rotates in the pivot sockets 58, that are drilled into the side wall of the dispenser vertical ends 28. A cutter housing 95 is formed into the roll top cover 52 and contains a saw tooth cutter 62, cutter safety guard 66 and a safety guard retainer 68. A handle 60 and the safety guard retainer 68 are secured by a handle and retainer screw 70. A back groove lock assembly 75 secures the parts associated with the back groove 26. There is a shelf 30 and vertical back 32 located above the roll top cover 52, said shelf 30 and back are fastened between the dispenser vertical ends 28. The main cavity of the dispenser is closed in by the roll top cover 52 and a curved back enclosure 44. Inside the dispenser, a phantom roll of plastic wrap 76 is shown being dispensed from the top of the roll.

FIG. 4B is a cut away side view illustrating the orientation of the parts of FIG. 4A when the roll top cover 52 is in the open position. A safety guard activator 72 pushes a cutter safety guard 66 out, shielding the saw tooth cutter 62, when the roll top cover 52 and the roll top cover end 54 are rotated to the open position. Dispensing plastic film wrap sanitarily is illustrated by a phantom loose end of plastic wrap 78.

Figure 5:
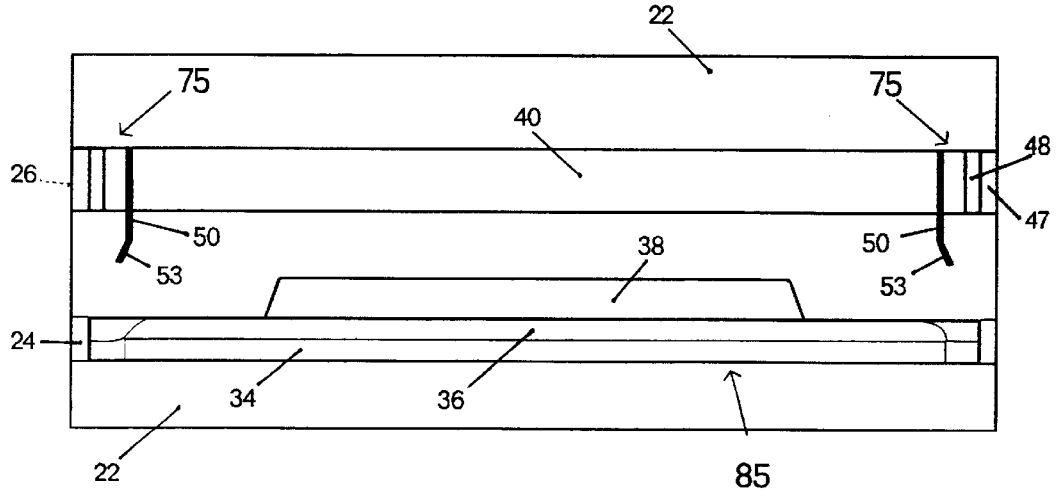
FIG. 5 is a top view illustrating the elongated trough of the dispenser in accordance with the present invention.

FIG. 5 is a top view illustrating an elongated trough in accordance with the present invention. The grooved base 22 is rectangular, having a front groove 24 and a back groove 26, length wise on the top side of said base.

Figure 6:
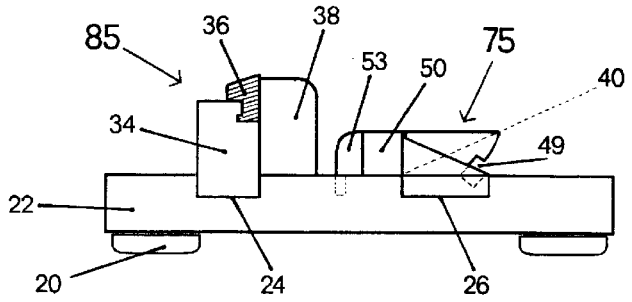
FIG. 6 is an end view illustration of FIG. 5.

The front stop assembly 85 is secured when a front enclosure 34 drops down into the front groove 24 (see FIG. 6). The roll retainer 38 is shorter than the front enclosure 34, creating an opening between the roll of plastic wrap (not shown) and said front enclosure 34. The back groove 26 is wider than the front groove 24, to accommodate an inclined plane stabilizer 40, which extends the length of the back groove 26, between the back groove lock assemblies 75.

FIG. 6 is an end view illustrating the grooved base 22 in accordance with the present invention. The grooved base 22 is flat on the under side, and having non-skid pads 20 on each corner. The front stop assembly 85, consists of a front enclosure 34, static bar 36, and a roll retainer 38.

The front enclosure 34 is rectangular in shape, having the top ends recessed. There is a rabbet and groove on the top inward edge, running the length of said enclosure. A static bar 36 locks into the front enclosure, rabbet & groove, then extends above said enclosure, vertically, then slopes upward to the back. The vertical back is flush with the front enclosure 34. The roll retainer 38 is rounded on the top inward facing corder, and having vertical sides and a flat bottom. The long flat side of the roll retainer 38 faces the static bar 36 and front enclosure 34, when assembled, the parts become the front stop assembly 85.

The back groove 26 holds the inclined plane stabilizer 40, loading guide 50, and back groove look assembly 75.

Figure 7:
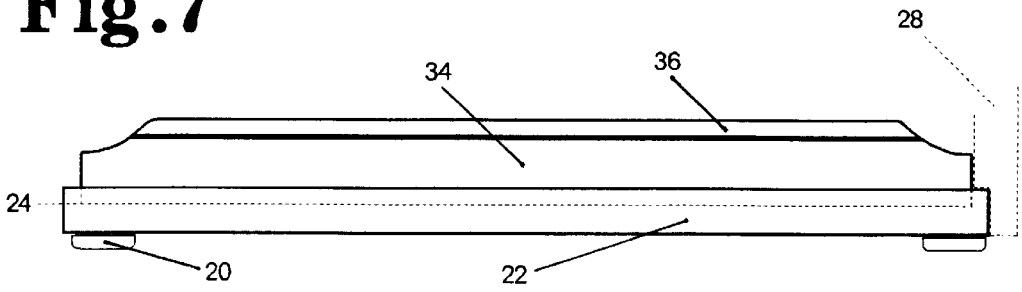
FIG. 7. is a front view of FIG. 5 illustrating the front enclosure.

FIG. 7 is a front view illustrating the grooved base 22, with front enclosure 34. The static bar 36 is mounted horizontally on top of the front enclosure 34. The top corners have contoured cutout sections to facilitate easy access to the plastic wrap. The bottom of the front enclosure 34 is cut at right angles and sits down into the front groove 24, to secure the front stop assembly.

Figure 8:
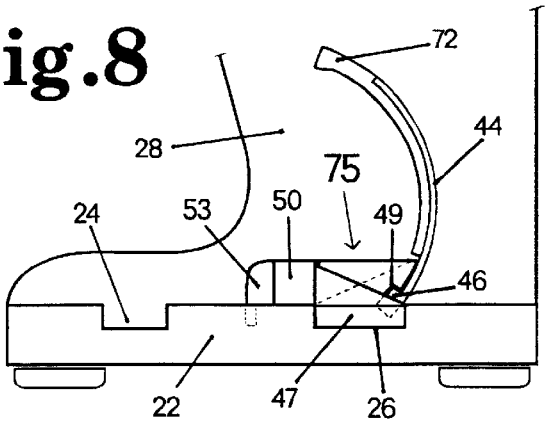
FIG. 8 is an end view illustrating the grooved base with back groove lock assembly and curved back enclosure.

FIG. 8 is an end view illustrating the grooved base 22, with curved back enclosure 44 orientate parts, in accordance with the present invention. A curved back enclosure 44 is a thin, long rectangular shape curved to match the inside of the roll top cover. The bottom inward facing corners of the curved back enclosure 44 has lugs 46 that engage a lug receiver 49. The top corners of the curved back enclosure 44 project upward, with the same curvature as said enclosure, these tab like extensions are reenforced to become safety guard activators 72.

Figure 9:
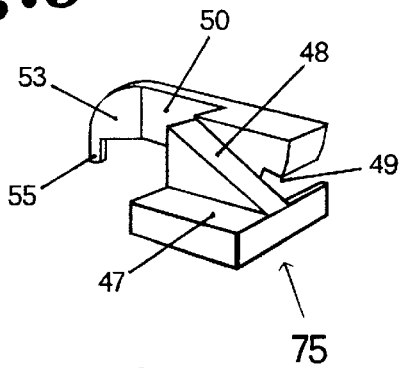
FIG. 9 is a perspective view illustrating the back groove lock assembly.

FIG. 9 is a perspective view illustrating the back groove lock assembly 75 in accordance with the present invention. The back groove lock assembly 75 has a flat bottom and vertical sides. The width of the bottom of said assembly 75 is sized to fit the back groove. A tenon is cut on the outward facing side of the back groove lock assembly 75, said tenon 47 fits under the dispenser vertical end. The middle section of said assembly 75 is cut away at an angle creating a ramp 48 to make room for a roll top cover end 54, when the roll top cover 52 is in the open position, see FIG. 4B. A lug receiver 49 on the back side of said assembly 75 is sized to receive the curved back enclosure lug 46. See FIG. 8. A loading guide 50 extends forward from said assembly, and has a bevel 53 at the front of the loading guide 50. The bottom of the loading guide 50 is cut away so the back groove lock assembly 75 will fit down into the back groove. A guide support pin 55 at the front bottom of the loading guide bevel 53 fits down into a drill hole in the grooved base 22, see FIG. 8.

Figure 10:
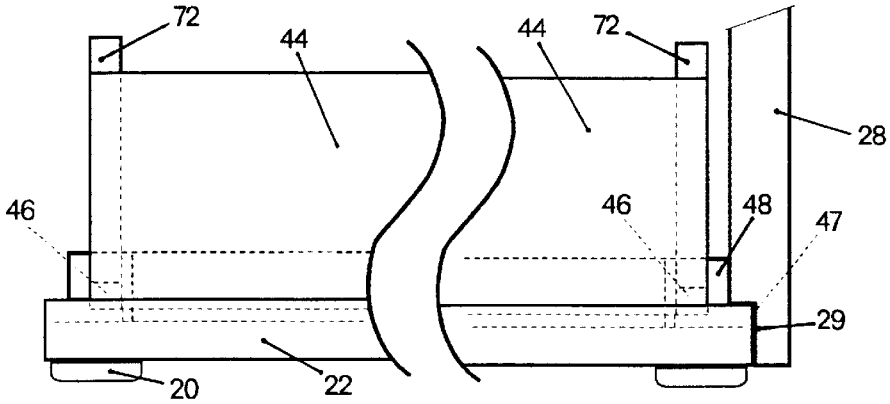
FIG. 10 is a rear side view of FIG. 8.

FIG. 10 is a rear side view of FIG. 8 showing the curved back enclosure 44 with safety guard activators 72, and lugs 46. The dispenser vertical end 28 secures the tenon 47 of the back groove lock assembly.

Figure 11A:
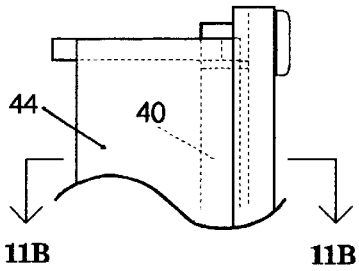
FIG. 11A is a sectional view of FIG. 10 minus the dispenser vertical end.

FIG. 11A is a sectional cut away view of the grooved base 22, curved back enclosure 44 and the inclined plane stabilizer 40 in accordance with the present invention.

Figure 11B:
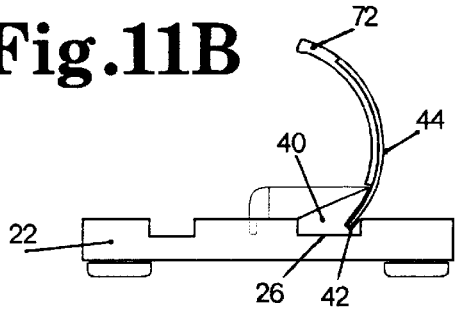
FIG. 11B is a sectional view of FIG. 11A.

FIG. 11B is a sectional view of FIG. 11A showing the grooved base 22, inclined plane stabilizer 40 and curved back enclosure 44, sliced about the mid point. The inclined plane stabilizer 40 is flat on the bottom with vertical sides. The front vertical height of said inclined plane stabilizer 40 is equal to the depth of the back groove 26. The incline starts at the top of the front vertical side and slopes upward from the front of said incline to back. The back side curves down into a slot 42 that runs the full length of the inclined plane stabilizer 40. The curved back enclosure 44 sits down into said slot 42, locking the inclined plane stabilizer 40 into the back groove 26. The slot 42 adds lengthwise support to the curved back enclosure 44.

Figure 12:
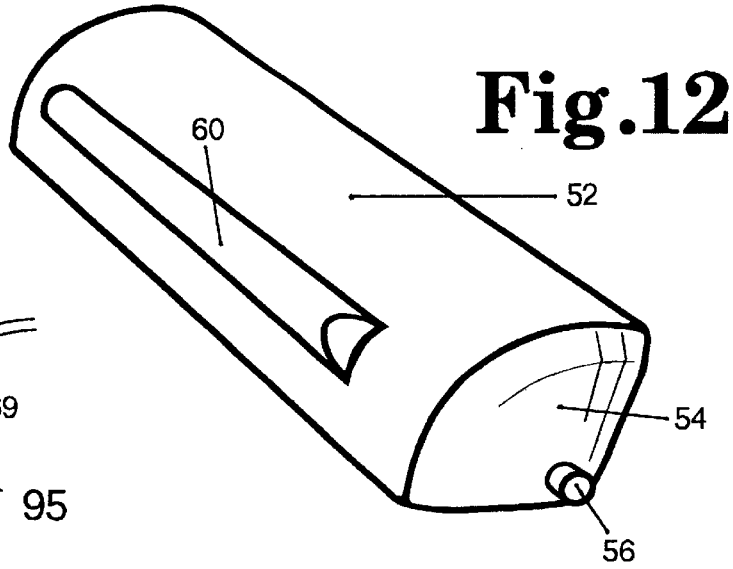
FIG. 12 is a perspective front view illustrating the roll top cover in accordance with the present invention.

FIG. 12 is a perspective view illustrating the roll top cover 52 in accordance with the present invention. The roll top cover 52, is a partial cylinder, being closed in on both ends, and having swivel pins 56 at the roll top cover axis. A handle 60 having a rectangular shape, straight back and front, concaved bottom and rounded top.

Figure 13:
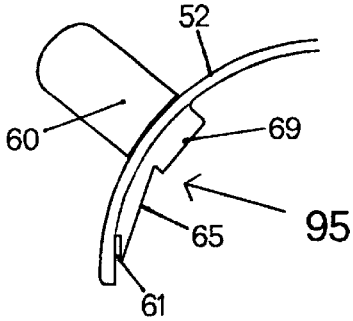
FIG. 13 is a cutaway end view of the roll top cover cutter housing.

FIG. 13 is a cut away end view of the roll top cover 52, handle 60 and cutter housing 95. The cutter housing 95 is molded into the front under side of the roll top cover 52, and consists of a cutter attach slot 61, along the front bottom of said housing 95. The flat mid section of the cutter housing 95 is called a cutter guard slide 65, and the raised back spacer is a safety guard retainer mount 69.

Figure 14:
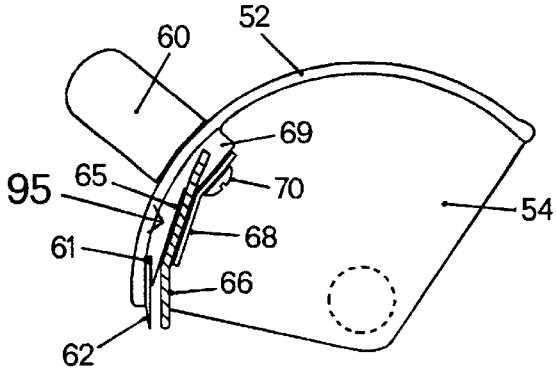
FIG. 14 is a cutaway end view illustrating the cutter housing and related parts.

FIG. 14 is a cut away end view illustrating the roll top cover 52, handle 60, cutter housing 95, and connecting parts. A saw tooth cutter 62 is bonded into the cutter attach slot 61. A cutter safety guard 66 is bent along the front length, matching the angle of the saw tooth cutter 62. A safety guard retainer 68 is bent lengthwise to an angle paralleling said retainer to the safety guard slide 65 when said retainer is fastened to the safety guard retainer mount 69, with a handle and retainer screw 70.

Figure 15:
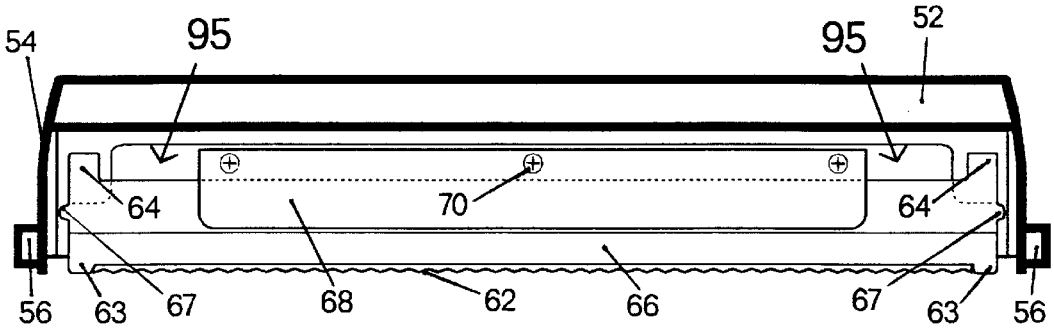
FIG. 15 is a rear side view illustrating the roll top cover in accordance with the present invention.

FIG. 15 is a rear side view illustrating the roll top cover 52, cutter housing 95 and connecting parts. The cutter housing 95 is molded parallel to the inside front of the roll top cover 52, and having both ends of said housing being cut away on the back. The cutter safety guard 66 is a long thin rectangular device, having lifting tabs 63 on the front ends, and push tabs 64 on the back ends. The cutter safety guard 66 has a bend along the front length that matches the angle of the saw tooth cutter 62. There is a nub 67 on each end of the cutter safety guard 66. The safety guard retainer 68 is a thin strip of material having a bend along its length. Said bend is just forward of the attach holes that are along the back of the safety guard retainer 68. The front corners of said retainer 68 are rounded.

DESCRIPTION OF ALTERNATIVE EMBODIMENT

Figure 16:
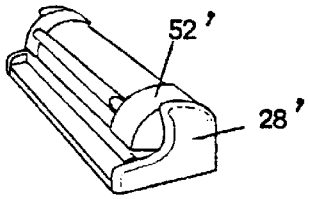
FIG. 16 is a perspective view of the plastic film wrap application process dispenser showing an alternative embodiment of FIG. 1.

FIG. 16 is a perspective view illustrating an alternative embodiment of FIG. 1. The dispenser shown in FIG. 16 is exactly the same as the dispenser of FIG. 1 with the following exceptions, the dispenser vertical ends 28' are shaped to follow the contour of the roll top cover 52', when the shelf 30 is omitted. The alternative embodiment is illustrated to eliminate confusion when examining the following figures.

OPERATION PROCESS

Figure 17A:
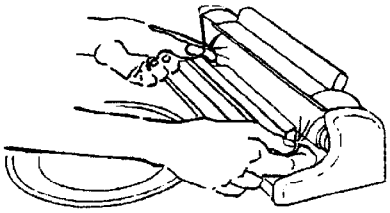
FIGS. 17A–17B–17C are perspective views illustrating the operation of the plastic film wrap application process dispenser.

FIG. 17A Place object to be wrapped in front of dispenser. Rotate roll top cover to the open position. Lift plastic film wrap off static bar with thumb and index fingers of both hands.

Figure 17B:
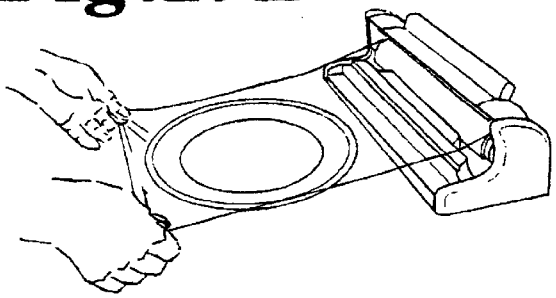

FIG. 17B Pull enough plastic wrap out of the dispenser to cover object to be wrapped, while the plastic film wrap is still attached to the dispenser. Wrap the two loose corners of the plastic film wrap that you are holding around the object being covered.

Figure 17C:
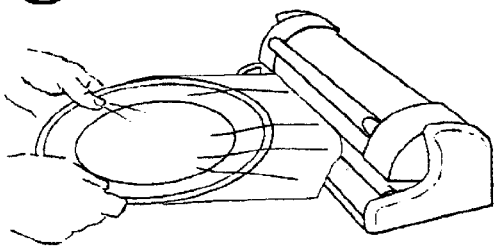

FIG. 17C Close the roll top cover of the dispenser. Lift and rotate wrapped object as you pull said object away, this will cut the plastic wrap.

Figure 18A:
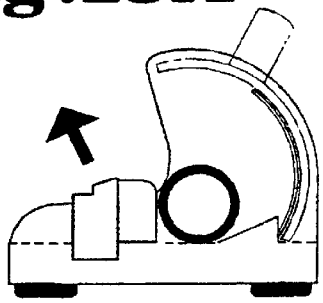
FIGS. 18A–18B–18C is a side view illustrating the loading process for the present invention.

FIG. 18A To load the dispenser, rotate the roll top cover to the open position & lift the front assembly out of the dispenser.

Figure 18B:
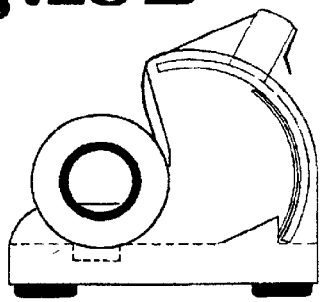

FIG. 18B Place a new roll of plastic wrap in the front groove and extend the loose end of the wrap up and over the roll top cover handle.

Figure 18C:
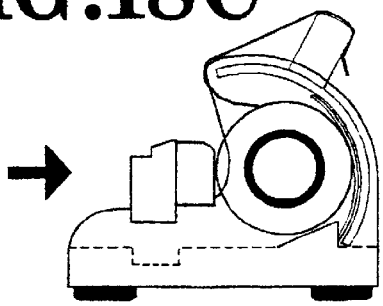

FIG. 18C With the front assembly in hand, push the new roll of plastic film wrap in and up the inclined plane stabilizer. Drop the front assembly down into the front groove. Close the roll top cover, then tear the excess plastic film wrap away.

I claim:

1. A dispenser for a roll of plastic film material comprising:

a base defining an elongated trough;

a roll top cover pivotably mounted between parallel end walls and pivotable between open and closed positions, said end walls adapted to support a shelf, said roll top cover being a partial cylinder closed in on both ends;

a removable front assembly comprising:

a front enclosure, a static bar whereby a loose end of said plastic film material rests, and a roll retainer;

said trough having a flat bottom and a concaved back wall which parallels said front enclosure;

a cutter and a movable cutter safety guard both disposed on said cover, said safety guard shielding said cutter when said roll top cover is in said open position;

wherein said concaved back wall includes safety guard activators disposed at an operative position such that when said roll top cover is in said open position, said safety guard activators abut said cutter safety guard an moves said cutter safety guard into shielding position with respect to the cutter.

2. The dispenser as claimed in claim 1, wherein said elongated trough includes an inclined plane surface adjacent said flat bottom to keep said roll of plastic film material in place.

3. The dispenser as claimed in claim 1 further comprising a handle disposed on said roll top cover.

4. The dispenser as claimed in claim 1, wherein said roll retainer is an inward protruding retainment wall.

5. The dispenser as claimed in claim 1, wherein said concaved back wall includes securing lugs thereby becoming a curved back enclosure for said roll top cover.

6. The dispenser as claimed in claim 1 further comprising a back groove lock assembly for removably mounting said concaved back wall.

7. The dispenser as claimed in claim 6, wherein the back groove lock assembly includes at least one lug receiver for receiving at lest one lug disposed on said concaved back wall; and at least one loading guide adapted to guide dispensing of said roll of plastic film material.

8. A dispenser for a roll of plastic film material comprising:

a base defining an elongated trough;

a roll top cover pivotably mounted between parallel end walls and pivotable between open and closed positions, said roll top cover being a partial cylinder closed in on both ends;

a removable front assembly comprising:

a front enclosure, a static bar whereby a loose end of said plastic film material rests, and a roll retainer;

said trough having a flat bottom and a concaved back wall which parallels said front enclosure;

a cutter and a movable cutter safety guard both disposed on said cover, said safety guard shielding said cutter when said roll top cover is in said open position;

wherein said concaved back wall includes safety guard activators disposed at an operative position such that when said roll top cover is in said open position, said safety guard activators abut said cutter safety guard and moves said cutter safety guard into shielding position with respect to the cutter.

* * * * *